US008333466B2

(12) United States Patent
Kanazawa

(10) Patent No.: US 8,333,466 B2
(45) Date of Patent: Dec. 18, 2012

(54) INK JET RECORDING APPARATUS

(75) Inventor: Manabu Kanazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 420 days.

(21) Appl. No.: 12/557,357

(22) Filed: Sep. 10, 2009

(65) Prior Publication Data

US 2010/0066794 A1 Mar. 18, 2010

(30) Foreign Application Priority Data

Sep. 12, 2008 (JP) ..... 2008-235088

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS

| | | | | |
|---|---|---|---|---|
| 5,270,738 | A | 12/1993 | Takahashi et al. | |
| 7,334,859 | B2 * | 2/2008 | Kojima | 347/19 |
| 7,866,659 | B2 * | 1/2011 | Izumichi et al. | 271/121 |
| 2007/0291095 | A1 | 12/2007 | Wada et al. | |
| 2008/0180507 | A1 * | 7/2008 | Furukawa | 347/104 |

* cited by examiner

*Primary Examiner* — Stephen Meier
*Assistant Examiner* — Tracey McMillion
(74) *Attorney, Agent, or Firm* — Canon U.S.A. Inc. IP Division

(57) ABSTRACT

An ink jet recording apparatus includes a conveyance mechanism, a recording mechanism and a control unit. The conveyance mechanism has a roller in contact with a recording surface of a sheet and conveys the sheet in a first direction. The recording mechanism records an image on a recording surface using a recording head on which a plurality of nozzles are formed over a range covering a width of a sheet to be used along a second direction crossing the first direction. The control unit, which controls the conveyance and recording mechanisms, performs an image record operation and a preliminary discharge operation onto the recording surface.

16 Claims, 10 Drawing Sheets

INK JET RECORDING APPARATUS

BACKGROUND OF THE INVENTION

1. Field of the Invention

The present invention relates to a recording apparatus which records on a sheet by discharging ink from a full-multiple ink jet recording head with a plurality of nozzles arranged in the direction crossing the direction in which the sheet is conveyed.

2. Description of the Related Art

Recording apparatus are divided into two types: one is of a serial type which alternately repeats the reciprocal movement of a carriage on which a recording head is mounted and the conveyance of a sheet; and another is of a line type which continuously records an image using a full-multiple recording head covering the width of a sheet.

Most ink jet recording apparatus perform a preliminary discharge by discharging ink, not for the purpose of recording, but to recover the apparatus from deterioration in the characteristics of ink in the nozzle of an ink jet recording head. U.S. Pat. No. 5,270,738 discusses a recording apparatus using a full-multiple recording head capable of performing the preliminary discharge.

U.S. Patent Application Publication No. US 2007/0291095 discusses a full-multiple recording head in which a substrate on which nozzles are formed is divided into a plurality of nozzle chips and staggered. The recording head has an area where the nozzles are overlapped in a nozzle array of adjacent nozzle chips in the direction crossing the conveyance direction. U.S. Patent Application Publication No. US 2007/0291095 discusses nothing about the preliminary discharge.

It is assumed that the full-multiple recording head including a plurality of staggered nozzle arrays preliminarily discharges ink onto the surface of the sheet.

When recording an image on the sheet, a number of discharges per nozzle in an overlapping part (overlapping area) is fewer than in a non-overlapping part (non-overlapping area). The preliminary discharge can be controlled such that the fewer the number of the discharges from the nozzle during the recording, the more the number of the preliminary discharges, in consideration of ink thickening. As a consequence, the number of the preliminary discharges from the nozzles in the overlapping area is greater than those in the non-overlapping area. As a result, a larger amount of ink is applied to the sheet in the overlapping area and the ink is transferred to the surface of a conveyance roller that contacts with the sheet, which may smear the conveyance roller. The ink stuck to the conveyance roller may be transferred to the sheet again after a single rotation of the conveyance roller.

SUMMARY OF THE INVENTION

According to an aspect of the present invention, an ink jet recording apparatus includes, a conveyance mechanism having a roller in contact with a recording surface of a sheet configured to convey the sheet in a first direction, a recording mechanism, provided on an upstream side in the first direction from the roller, configured to record an image on the recording surface using a recording head on which a plurality of nozzles are formed over a range covering a width of a sheet to be used along a second direction crossing the first direction, and a control unit which controls the conveyance mechanism and the recording mechanism to perform an image record operation and a preliminary discharge operation onto the recording surface, wherein a nozzle surface of the recording head is formed with a plurality of nozzle chips each having a plurality of nozzles such that an adjacent nozzle chip is arranged to be shifted with respect to the first and the second directions, and the plurality of nozzles included in the adjacent nozzle chip have an overlapping area in the second direction, the roller has contact portions that can contact with the sheet and non-contact portions formed alternately along a direction of a rotational axis of the roller, each of the contact portions is formed corresponding to each of the nozzle chips in the second direction and each of the non-contact portions is formed corresponding to each of the overlapping areas in the second direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Figure 1:
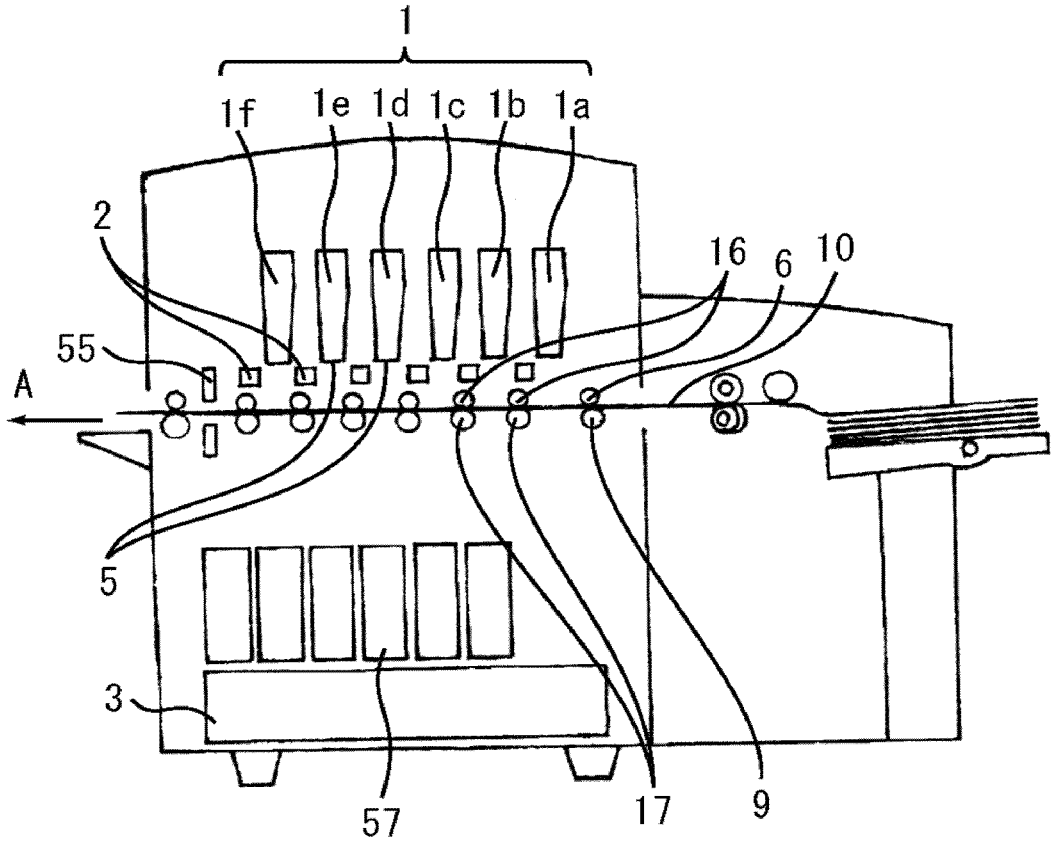
FIG. 1 is a vertical section illustrating a recording apparatus according to a first exemplary embodiment.

Various exemplary embodiments, features, and aspects of the invention will be described in detail below with reference to the drawings.

The same reference numerals and characters denote the similar or corresponding parts throughout the drawings.

Figure 2:
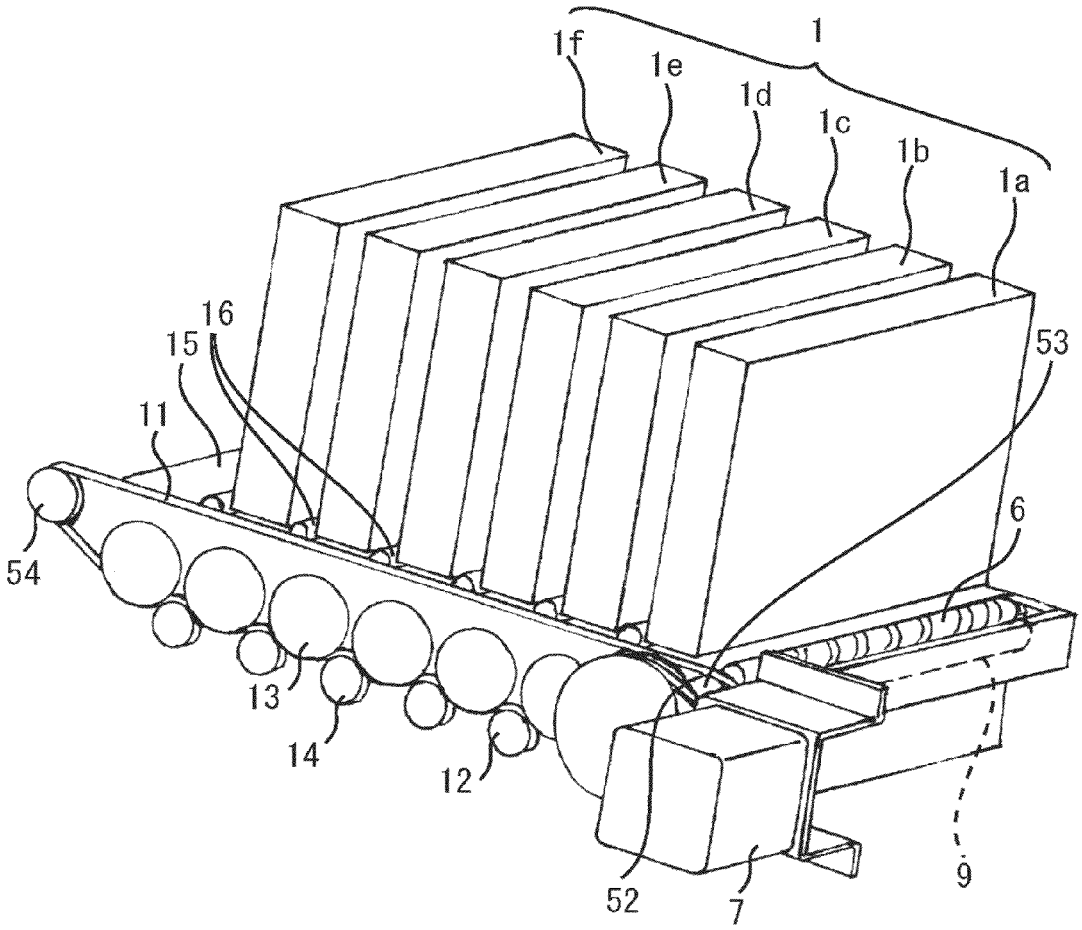
FIG. 2 is a perspective view illustrating a principal part of the ink jet recording apparatus.

FIG. 1 is a vertical section illustrating an ink jet recording apparatus according to a first exemplary embodiment. FIG. 2 is a perspective view illustrating a principal part of the ink jet recording apparatus. A recording mechanism 1 including a recording head is a full-multiple recording head in which nozzles are formed on a nozzle surface 5. A length of the surface 5 covers the width of a sheet 10 substantially throughout the entire area in a second direction crossing a first direction in which the sheet is conveyed (a direction orthogonal to the first direction, in the present exemplary embodiment). The recording head is of ink jet type. The ink jet recording head may use a heating element, a piezoelectric element, an electrostatic element, or a microelectromechanical system (MEMS) element. The recording mechanism 1 includes six recording heads 1*a*, 1*b*, 1*c*, 1*d*, 1*e*, and if which are arranged at regular intervals in a conveyance direction A and correspond to the number of ink colors. Recovery units 2 are movably arranged in the vicinity of the recording heads of the recording mechanism 1. Each recovery unit 2 is provided with a wiper for cleaning the nozzle surface 5 and a cap, which makes close contact with the nozzle surface 5 to prevent the nozzle from drying. The sheet 10, which is a recording medium, is conveyed in the direction A indicated by an arrow (i.e., the first direction).

The ink jet recording apparatus is provided with ink tanks 57 corresponding to the number of ink colors. Each recording head is supplied with ink from the ink tank 57 by a pump. The recording head is driven while the sheet is being conveyed to sequentially form an image in each color. The image formation sheet 10 is conveyed in the direction A indicated by the arrow, discharged from a discharge port and stacked on a discharge tray. If discharge, the recorded sheet may be cut by a cutter 55. The ink jet recording apparatus includes a control unit 3 (controller) incorporating a CPU, a memory, and various I/O interfaces to control the operation of the entire apparatus. The control unit 3 controls a conveyance mechanism and the recording mechanism 1 to perform an operation for recording images on the recording surface of the sheet and for preliminarily discharging ink on the recording surface of the sheet.

Figure 3:
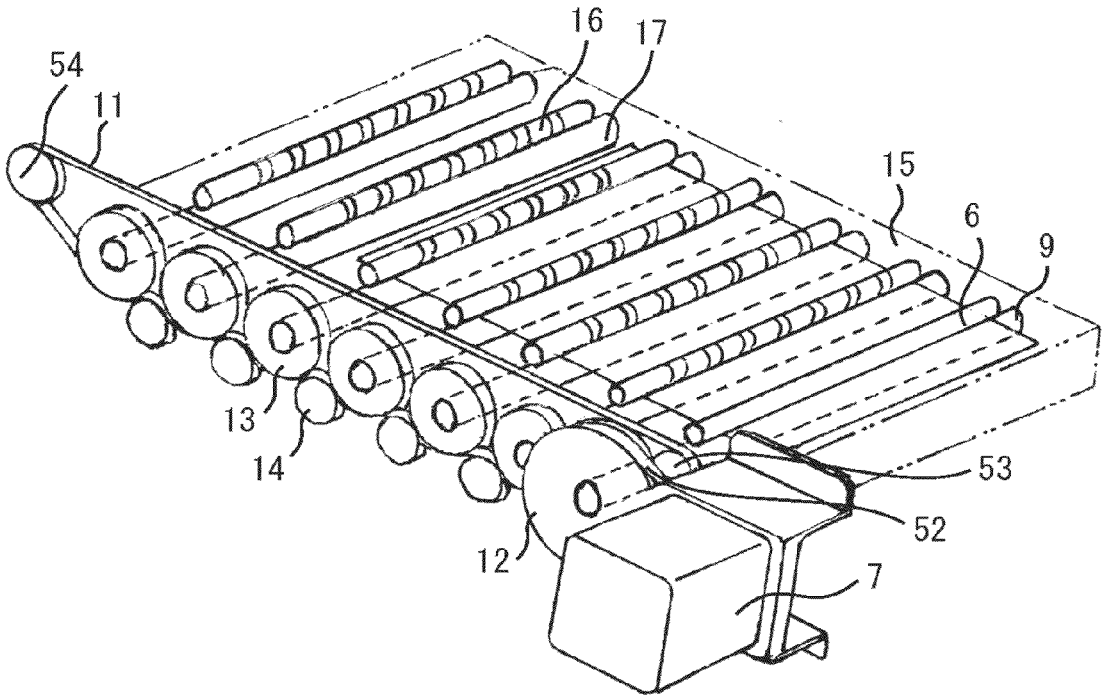
FIG. 3 is a perspective view illustrating a sheet conveyance mechanism.
Figure 4:
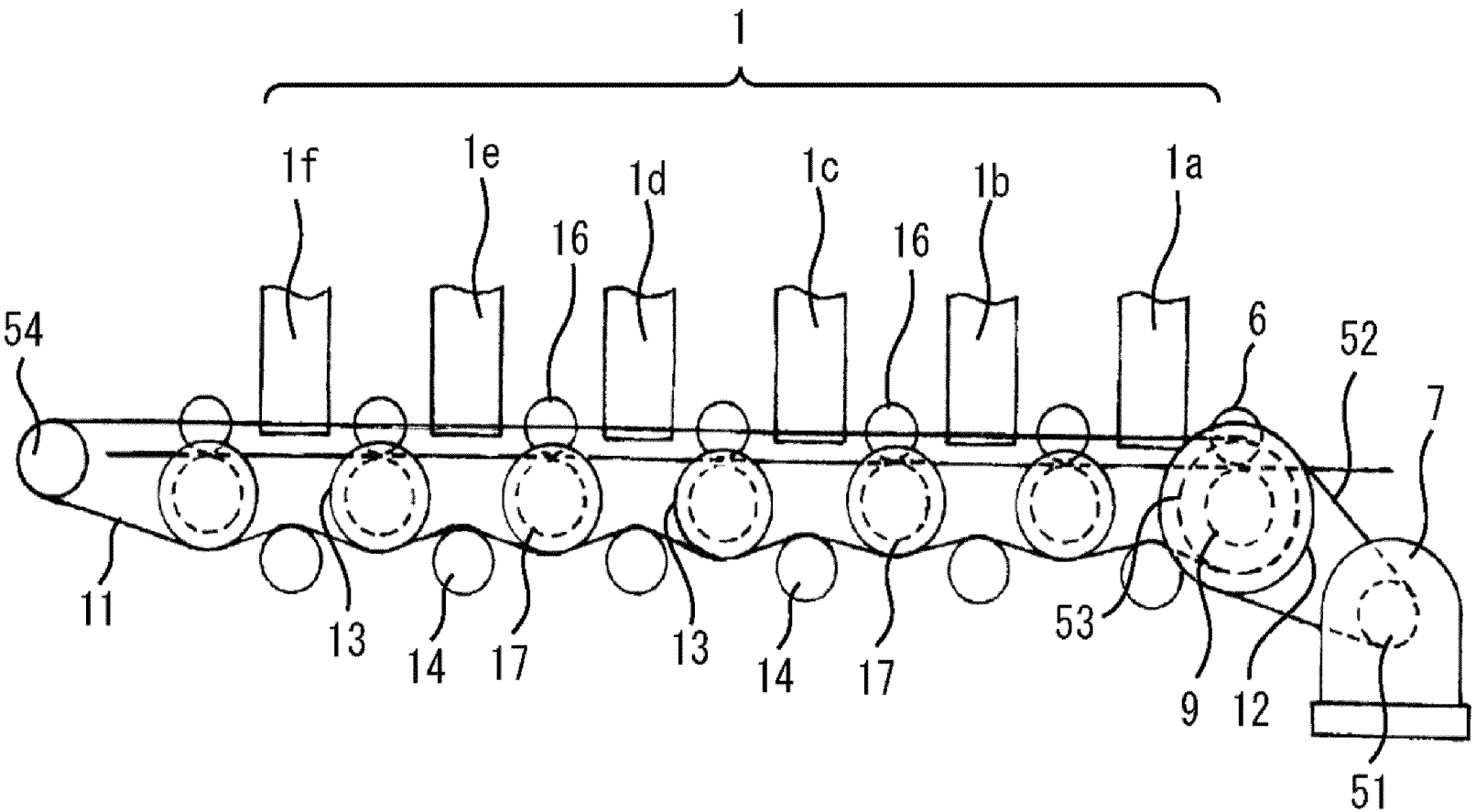
FIG. 4 is a vertical section illustrating the sheet conveyance mechanism.
Figure 5:
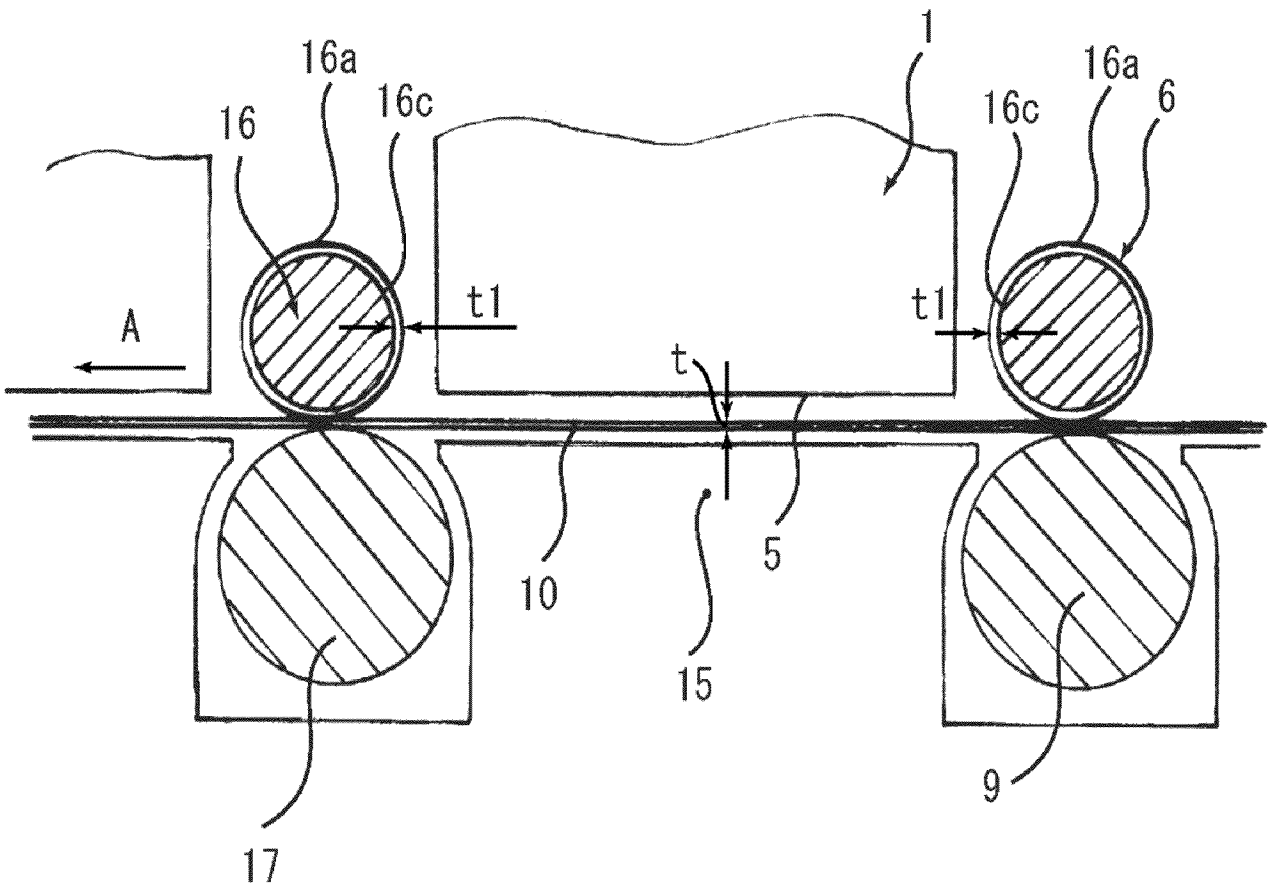
FIG. 5 is a partial vertical section illustrating a conveyance roller.

The conveyance mechanism for conveying the sheet in a position opposing the recording mechanism 1 is described with reference to FIGS. 3, 4, and 5. A drive roller 9 provided with a rotation drive amount for conveying the sheet 10 is arranged in the vicinity of the upstream side of the recording head la at the furthest upstream in the conveyance direction. The drive roller 9 is pressed by a pinch roller 6 which is driven and rotated therewith. Between the recording heads of the recording mechanism 1, there are arranged feed rollers 17 which are provided with a rotation drive force and rotate in synchronization with the drive roller 9 and follower rollers 16 pressed against the feed rollers 17 respectively. The drive roller 9 and the feed rollers 17 are arranged on the back side of the sheet (non-recording surface). The pinch roller 6 and the follower rollers 16 are arranged on the recording surface (the front side) of the sheet. A conveyance roller pair is formed of the drive roller 9 and the pinch roller 6. A plurality of feed roller pairs includes the feed rollers 17 and the follower rollers 16. The roller pairs for conveying the sheet are arranged in a plurality of positions in the conveyance direction. All of the rollers that are in contact with the recording surface of the sheet are the follower rollers.

A conveyance pulley 12 is provided at one end portion of the drive roller 9. The drive roller 9 is driven by transmitting the rotation of a conveyance motor 7 to the conveyance pulley 12 through a motor pulley 51 and a drive belt 52. The feed rollers 17 are arranged between the recording heads of the recording mechanism 1 and in the vicinity of the recording head if located at the furthest downstream. A feed pulley 13 is fixed to one end of the feed roller 17. A drive pulley 53 is fixed to one end of the drive roller 9. An idler pulley 54 is arranged on the downstream side of the recording head if located at the furthest downstream. An endless conveyance belt 11 is stretched between the drive pulley 53 and the idler pulley 54. The upper traveling portion of the conveyance belt 11 passes over the feed pulleys 13 and the lower traveling portion thereof passes beneath the feed pulleys 13. Tension pulleys 14 urged upward by a spring are arranged between the drive pulley 53 and the feed pulleys 13. The conveyance belt 11 is urged into engagement with the drive pulley 53 and the feed rollers 17 by the tension pulleys 14.

When the drive roller 9 is driven by conveyance motor 7, the feed rollers 17 can be rotated in synchronization with the drive roller 9 through the conveyance belt 11, together with which the pinch roller 6 and the follower rollers 16 are rotated to convey the sheet 10 in the direction A indicated by the arrow. The pressing force of the follower roller 16 against the feed roller 17 is set weaker than the pressing force of the pinch roller 6 against the drive roller 9 arranged at the furthest upperstream; a basic conveyance accuracy is determined by a nip force produced by the drive roller 9 and the pinch roller 6. A platen 15 for supporting the sheet 10 is disposed in a position opposing the nozzle surface 5 of the recording mechanism 1 with a predetermined gap from the nozzle surface 5. Thus, the conveyance mechanism includes the conveyance roller and the rollers on the recording surface side. The conveyance roller on the back side of the sheet includes the drive roller 9 and the feed rollers 17 and the rollers on the recording surface side includes the pinch roller 6 and the follower rollers 16.

Figure 6:
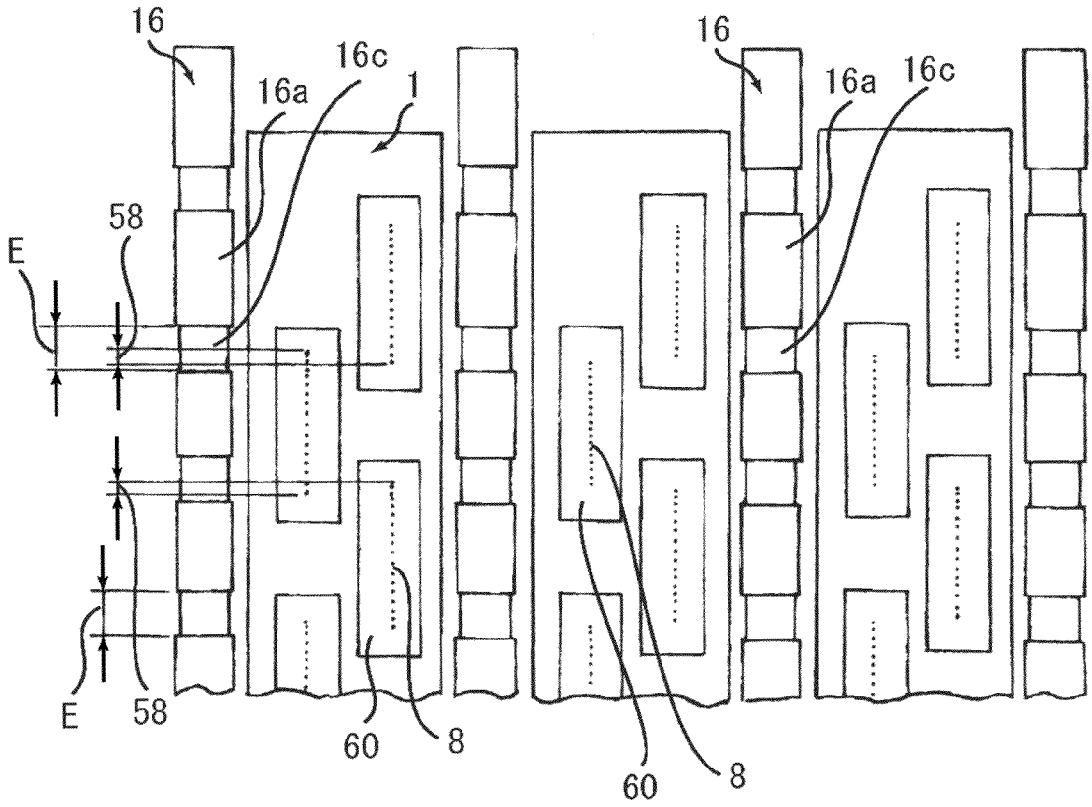
FIG. 6 is a diagram illustrating the nozzle surface of the recording head and the roller on the side of the recording surface, as viewed upward. (enlarged view)
Figure 7:
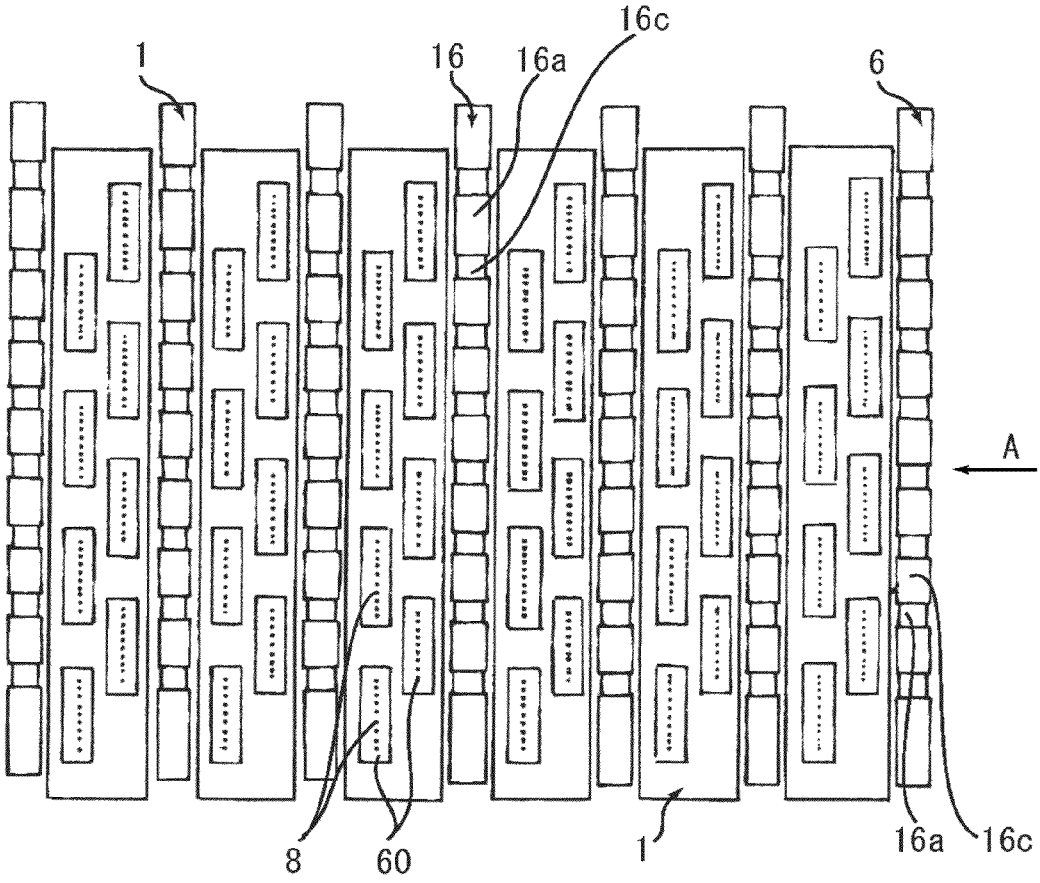
FIG. 7 is a diagram illustrating the nozzle surface of the recording head and the roller on the side of the recording surface, as viewed upward.

FIG. 6 and FIG. 7 are diagram illustrating the nozzle surface of the recording head and the roller on the side of the recording surface, as viewed upward. FIG. 6 is a partially enlarged view of FIG. 7. Each recording head arranged in the direction A indicated by the arrow is the full multiple recording head extending in the width direction of the sheet 10. Each recording head includes a plurality (4000, for example) of nozzles (nozzle array 8) arranged along the second direction over the range covering the width of the sheet to be used. In the recording head according to the present exemplary embodiment, the plurality of nozzles arranged throughout the nozzle surface 5 is divided into units of the predetermined number of the nozzle arrays 8. The plurality of nozzle arrays 8 is arranged with their positions alternately shifted in the conveyance direction and provided with an overlapping area 58 between the adjacent nozzle arrays 8 in the direction crossing the conveyance direction. The nozzle array 8 is formed on a nozzle chip 60 of a single substrate. The nozzle chips 60 are staggered in two columns along the second direction.

The pinch roller 6 and the follower roller 16 which are the conveyance rollers are arranged on the recording surface side of the sheet 10. The pinch roller 6 and the follower roller 16 are provided with a non-contact portions 16*c* each with a width E equal to or greater than the width of an overlapping area 58 in positions corresponding to the overlapping areas 58 of the adjacent nozzle arrays 8 in the second direction. The area excluding the non-contact portions 16*c* are contact portions 16*a* in contact with the sheet. Each of the non-contact portions 16*c* is dented relative to each of the contact portions 16*a* and a diameter of each of the non-contact portions 16*c* is smaller than each of the contact portions 16*a*. Thereby the non-contact portions 16*c* are not in contact with the conveyed sheet 10. Otherwise the non-contact portions 16*c* are in contact with the conveyed sheet 10 with a small contact pressure which is smaller than that of the contact portions 16*a*. In the present invention, "non-contact" includes both meanings as mentioned above. For example, as illustrated in FIG. 5, a difference t1 in radius between the contact portion 16*a* holding the sheet and the non-contact portion 16*c* smaller than the contact portion 16*a* is greater than the thickness "t" of a sheet which is larger than any sheets presumed to be used. The non-contact portions 16*c* and the contact portions 16*a* are integrally formed as a single roller and high in stiffness. The single roller is produced by molding or cutting.

Thus, the nozzle surface of the recording head is formed with a plurality of nozzle chips each having a plurality of nozzles such that the adjacent nozzle chip is arranged to be shifted with respect to the first and the second directions, and a plurality of nozzles included in the adjacent nozzle chip has an overlapping area 58 in the second direction. The roller that contacts with the recording surface of the sheet the roller has contact portions that can contact with the sheet and non-contact portions formed alternately along a direction of a rotational axis of the roller, each of the contact portions is formed corresponding to each of the nozzle chips in the second direction and each of the non-contact portions is formed corresponding to each of the overlapping areas 58 in the second direction.

The nozzles arranged in the overlapping area 58 perform the fewer number of ink discharges per nozzle in recording. Accordingly, a larger number of ink discharges is used per nozzle for the preliminary discharge. This increases the amount of ink adhering to the sheet in recording in the overlapping area 58. Therefore, the ink is transferred onto the pinch roller 6 and the follower rollers 16 on the recording surface side, and the ink is re-transferred onto the sheet 10, which is liable to degrade image quality. In the present exemplary embodiment, to solve the above problem, the non-contact portions 16*c* are provided on the pinch roller 6 and the follower rollers 16 to prevent the ink supplied onto the recording surface in the overlapping area 58 from being transferred onto the rollers. In addition, the contact portions 16*a* are formed in a plurality of positions corresponding to all the nozzle chips 60 in the second direction and hold the sheet therebetween over a wide area, so that a sufficient conveyance force can be provided and the sheet is prevented from being locally floated up.

A relationship is described between the number of discharges (the amount of discharge) per nozzle in recording images and preliminary discharge. When the nozzle chips 60 are staggered in two columns, the number of the nozzles in the direction in which the sheet is conveyed (the first direction) in the overlapping area 58 becomes twice that of the nozzles in the non-overlapping area where nozzles are not overlapped. In an image record operation, the control unit reduces the number of discharges per nozzle in the overlapping area 58 to half of the number of discharges per nozzle in the non-overlapping area to equalize the number of discharges in any area in the width direction. When the number of discharges in recording images is fewer, the nozzles are more liable to dry, so that the number of discharges per nozzle in the overlapping area 58 is to be increased in a preliminary discharge operation.

On the pinch roller 6 and the plurality of follower rollers 16, there are provided the plurality of contact portions 16*a* which holds the sheet 10 therebetween and the plurality of non-contact portions 16*c* which are not in contact with the sheet. The area excluding the non-contact portion 16*c* is the contact portion. The contact portion and the non-contact portion 16*c* are alternately formed along a direction of a rotational axis of the roller. Each of the contact portions 16*a* is formed=corresponding to each of all the nozzle chips in the second direction. Each of the non-contact portions 16*c* is formed corresponding to each of the overlapping areas 58 in the second direction. Each of the non-contact portions 16*c* has the width E equal to or greater than the width of each of the overlapping areas 58 in the second direction.

The sheet 10 is held by a nipping force between the drive roller 9 and the pinch roller 6 and a nipping force between the feed rollers 17 and the follower rollers 16. The nipping force is obtained at the contact portion of each roller. The non-contact portion 16*c* is smaller in radius than the contact portion 16*a*, i.e., a difference between the contact portion 16*a* and the non-contact portion 16*c* is greater than the thickness of the sheet to be used, so that the sheet will not contact with the periphery of the non-contact portion 16*c*.

According to the present exemplary embodiment, the nozzles in the overlapping area 58 preliminarily discharge as frequently as possible to prevent the ink from being transferred from the recording surface to the pinch roller 6 and the follower roller 16 even if the ink overflows to the recording surface. This may reduce degradation in image quality attributed to the re-transference of ink to the sheet 10. Furthermore, the contact portions are provided on the roller corresponding to all the nozzle chips to prevent the sheet from being locally floated up during conveyance and a sufficient force for holding the sheet is obtained. In the configuration of U.S. Patent Application Publication No. US 2007/0291095, rollers are provided only in positions corresponding to nozzle chips on the one column of stagger arrangement, so that a number of positions for pressing the sheet is fewer, which is liable to cause the sheet to be floated up in position where the sheet is not pressed. Moreover, a force for holding the sheet between the contact portions can be insufficient.

Figure 8:
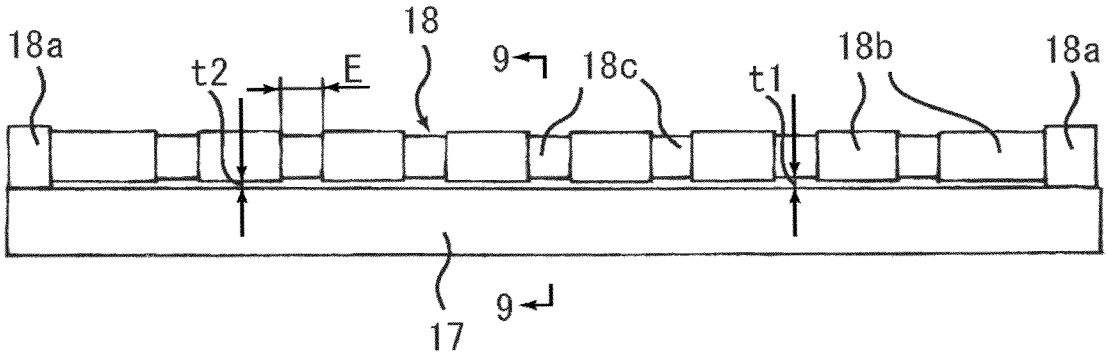
FIG. 8 is a front view illustrating a feed and a follower roller of the recording apparatus according to a second exemplary embodiment.
Figure 9:
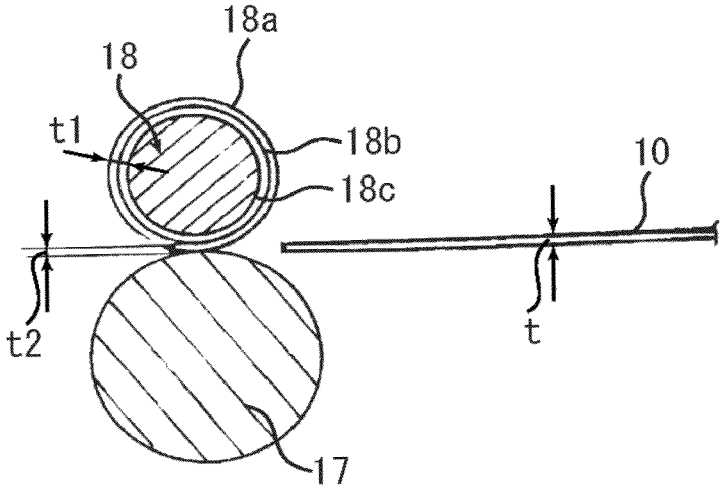
FIG. 9 is a vertical section taken along line g-g of FIG. 8.

FIG. 8 is a front view illustrating a feed and a follower roller of an ink jet recording apparatus according to a second exemplary embodiment. FIG. 9 is a vertical section taken along line g-g of FIG. 8. While the present exemplary embodiment is different from the first exemplary embodiment in that a follower roller 18 is used instead of the follower roller 16, in other respects, the present exemplary embodiment is similar in configuration to the first exemplary embodiment.

The follower roller 18 is in contact with a feed roller 17 at outermost portions 18*a* positioned at both ends thereof. The outermost portion 18*a* is provided in a portion where the sheet does not pass. In a portion inside the outermost portion 18*a* where the sheet passes, there are alternately formed a plurality of contact portions 18*b* and non-contact portions 18*c*. The non-contact portion 18*c* is formed in a position corresponding to the overlapping area 58 of the adjacent nozzle chips of the recording head. The non-contact portion 18*c* has a width E equal to or greater than the width of the corresponding overlapping area 58. A radius of the contact portion 18*b* is t2 smaller than the outermost portion 18*a* and t2 is smaller than the width "t" of the sheet 10 to be used. A radius of the non-contact portion 18*c* is still smaller than that of the contact portion 18*b*. A difference t1 in radius between the non-contact portion 18*c* and the outermost portion 18*a* is greater than the thickness "t" of the sheet 10. The sheet 10 is held between the contact portion 18*b* and the feed roller 17 through a gap t2, which is smaller than the thickness of the sheet in conveying the sheet. When a sheet's leading edge is inserted into the gap t2, the existence of the gap reduces the amount of lifting of the follower roller 18, which may decrease variation in conveyance resistance. As for the rest, the present exemplary embodiment has the similar effect to the first exemplary embodiment.

Figure 10:
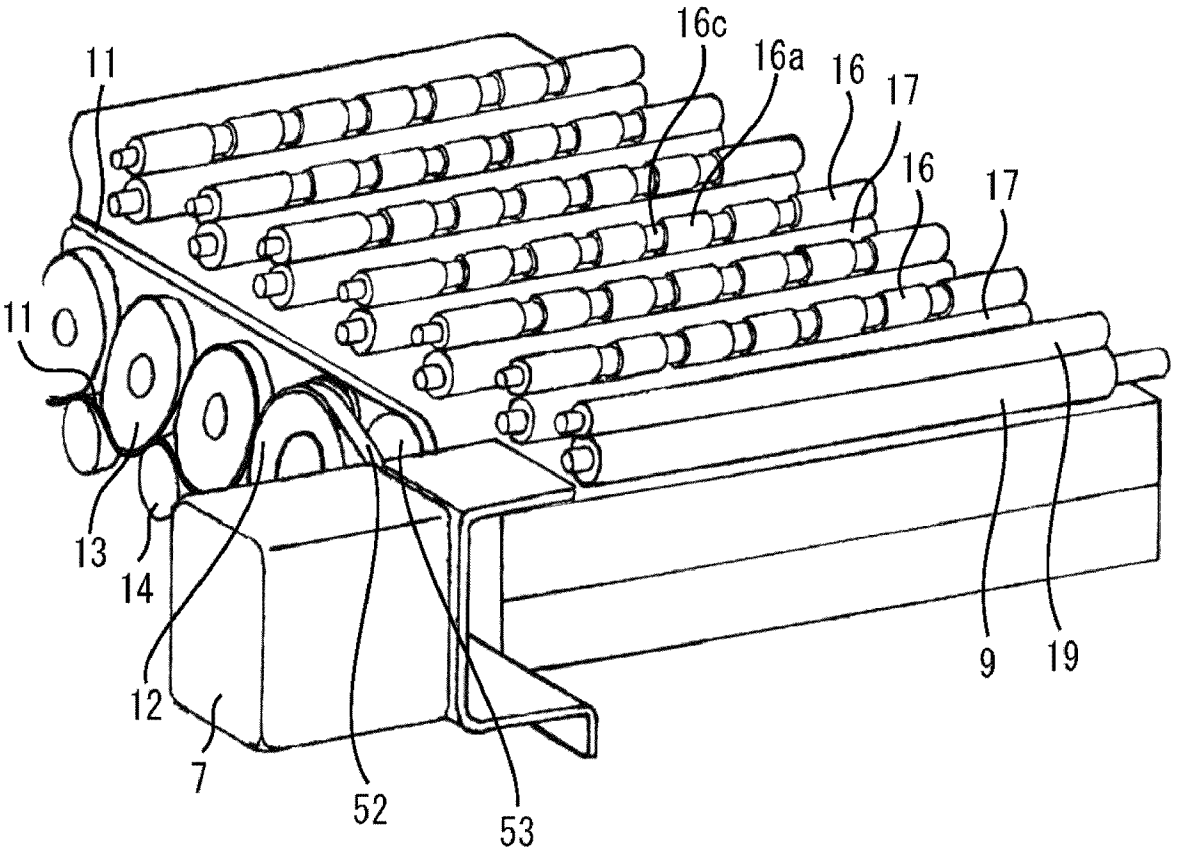
FIG. 10 is a perspective view illustrating the conveyance mechanism of a recording apparatus according to a third exemplary embodiment.
Figure 11:
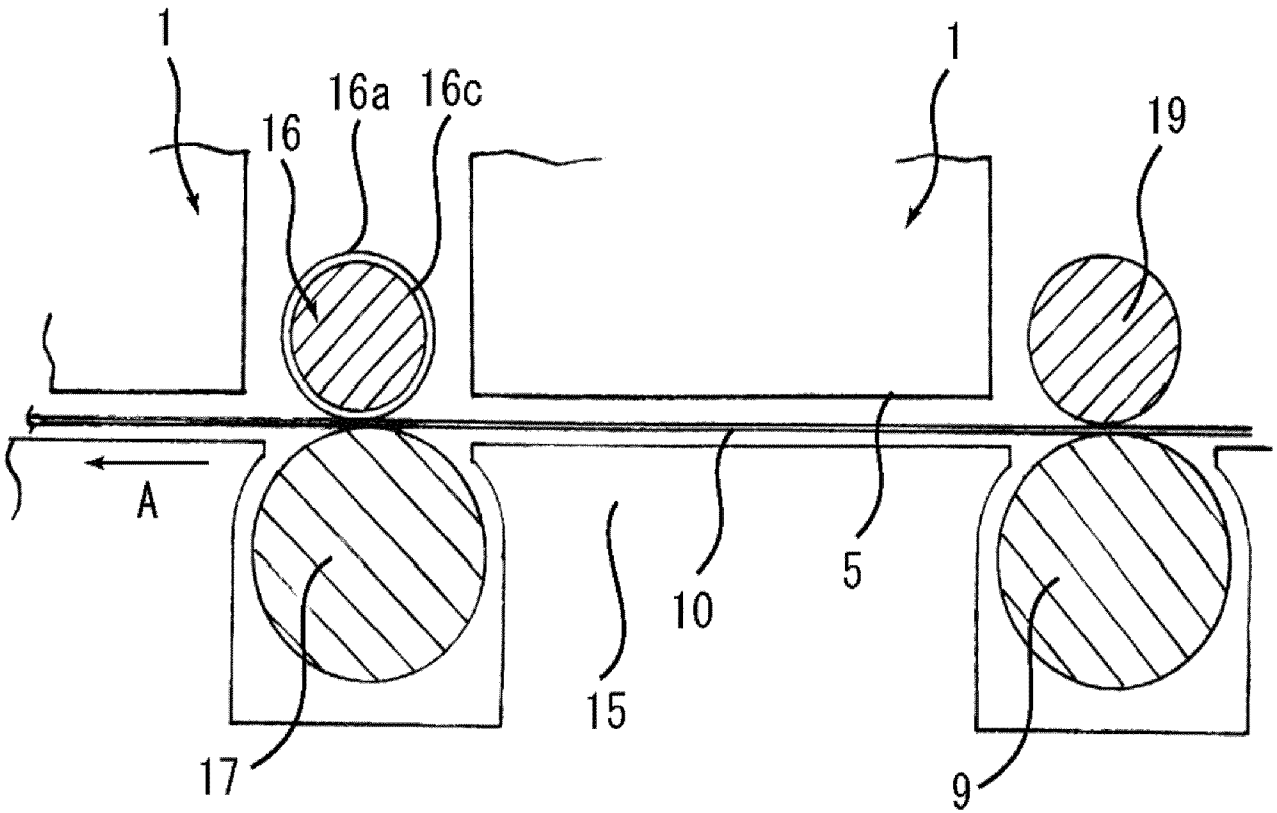
FIG. 11 is a vertical section illustrating a portion on the upstream side in the conveyance direction in FIG. 10.

FIG. 10 is a perspective view illustrating the conveyance mechanism of an ink jet recording apparatus according to a third exemplary embodiment. FIG. 11 is a vertical section illustrating a portion on the upstream side in the conveyance direction in FIG. 10. In the present exemplary embodiment, the conveyance roller arranged on the furthest upstream of conveyance on the recording surface side is formed of the pinch roller 19 which have the same diameter throughout the area where the sheet passes. As for the rest, the present exemplary embodiment is similar in configuration to the first exemplary embodiment.

The pinch roller 19 has the same diameter in the area where the pinch roller 19 pressed against the drive roller 9 abuts on the sheet, which ensures a high nip pressure throughout the pinch roller, which substantially affects a conveyance accuracy immediately before a recording process. Thus, still higher accuracy and stabilization of sheet conveyance are achieved in the vicinity of the full-multiple recording head. Similar to the first exemplary embodiment, the non-contact portion 16*c* wider than the overlapping area 58 is provided in the other follower rollers 16 at positions corresponding to the overlapping area 58 of the adjacent nozzle arrays 8 on the recording surface side.

While the recording apparatus using a plurality of the full-multiple recording heads is taken as an example in the above exemplary embodiments, the present invention is also applicable to the case where a single full-multiple recording head is used. While the nozzle chips including nozzle arrays are staggered in two columns as an example, the nozzle chips may be arranged in three or more columns with overlapping areas. In other words, the nozzle surface of the recording head may be configured such that a plurality of the adjacent nozzle chips may be arranged to be shifted with respect to the first and the second direction and a plurality of nozzles included in the adjacent nozzle chips has an overlapping area in the second direction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-235088 filed Sep. 12, 2008, which is hereby incorporated by reference herein in its entirety.

What is claimed is:

1. An ink jet recording apparatus comprising:

a conveyance mechanism having a roller in contact with a recording surface of a sheet configured to convey the sheet in a first direction;

a recording mechanism, provided on an upstream side in the first direction from the roller, configured to record an image on the recording surface using a recording head on which a plurality of nozzles are formed over a range covering a width of a sheet to be used along a second direction crossing the first direction; and a control unit which controls the conveyance mechanism and the recording mechanism to perform an image record operation onto the recording surface;

wherein a nozzle surface of the recording head is formed with a plurality of nozzle chips each having a plurality of nozzles such that an adjacent nozzle chip is arranged to be shifted with respect to the first and the second directions, and the plurality of nozzles included in the adjacent nozzle chip have an overlapping area in the second direction, and wherein, the roller has contact portions that can contact with the sheet and non-contact portions formed alternately along a direction of a rotational axis of the roller, each of the contact portions is formed corresponding to each of the nozzle chips in the second direction and each of the non-contact portions is formed corresponding to each of the overlapping areas in the second direction.

2. The ink jet recording apparatus according to claim 1, wherein the plurality of nozzle chips are staggered in two columns along the second direction.

3. The ink jet recording apparatus according to claim 1, wherein each of the non-contact portions is equal to or greater in width than each of the overlapping areas in the second direction.

4. The ink jet recording apparatus according to claim 1, wherein a diameter of each of the non-contact portions is smaller than each of the contact portions, and the non-contact portions and the contact portions are integrally formed as a single roller.

5. The ink jet recording apparatus according to claim 1, wherein the contact portions and the non-contact portions are formed in an area where a sheet passes with respect to the second direction, outermost portions are provided at both ends outside the area where the sheet passes, a radius of each of the contact portions is smaller than that of each of the outermost portions and a difference in radius between each of the contact portions and each of the outermost portions is smaller than a thickness of a sheet to be used.

6. The ink jet recording apparatus according to claim 1, wherein a plurality of the recording heads and a plurality of the rollers are arranged along the first direction and each of the rollers is provided corresponding to each of the recording heads.

7. The ink jet recording apparatus according to claim 6, further comprises a roller of a uniform diameter arranged in a furthest stream in the first direction.

8. The ink jet recording apparatus according to claim 1, wherein the roller is a follower roller and a feed roller with to which a driving force is applied is provided opposing to the follower roller.

9. A recording apparatus comprising:

a conveyance mechanism having a roller in contact with a recording surface of a sheet configured to convey the sheet in a first direction;

a recording mechanism, provided on an upstream side in the first direction from the roller, configured to record an image on the recording surface using a recording head on which a plurality of recording elements are formed over a range covering a width of a sheet to be used along a second direction crossing the first direction; and a control unit which controls the conveyance and recording mechanisms to perform an image record operation onto the recording surface;

wherein a surface of the recording head is formed with a plurality of chips each having a plurality of recording elements such that an adjacent chip is arranged to be shifted with respect to the first and the second directions, and the plurality of recording elements included in the adjacent chip have an overlapping area in the second direction, and wherein the roller has contact portions that can contact with the sheet and non-contact portions formed alternately along a direction of a rotational axis of the roller, each of the contact portions is formed corresponding to each of the chips in the second direction and each of the non-contact portions is formed corresponding to each of the overlapping areas in the second direction.

10. An ink jet recording apparatus comprising:

a recording head comprising a first nozzle array where a plurality of nozzles is arranged along a crossing direction crossing a conveyance direction of a sheet and a second nozzle array where a plurality of nozzles is arranged along the crossing direction on a downstream side of the first nozzle array in the conveyance direction, the first nozzle array and the second nozzle array partially overlaps in the crossing direction; and a roller pair comprising a first roller arranged on a downstream side of the recording head in the conveyance direction and in contact with a back surface of a sheet and a second roller in contact with a recording surface of the sheet, wherein the second roller is provided with non-contact portions, which are not in contact with the recording surface of the sheet, in positions corresponding to respective overlapping areas of the first nozzle array and the second nozzle array.

11. The ink jet recording apparatus according to claim 10, wherein the non-contact portions has a diameter smaller than contact portions of the second roller in contact with the recording surface of the sheet.

12. The ink jet recording apparatus according to claim 11, wherein the non-contact portions and the contact portions of the second roller are integrally formed.

13. The ink jet recording apparatus according to claim 10, wherein the first roller is a feed roller with a drive force being transmitted from a motor, and wherein the second roller is a follower roller rotating in synchronization with the first roller.

14. The ink jet recording apparatus according to claim 10, wherein each of the non-contact portion has a length longer than each of the corresponding overlapping areas in the crossing direction.

15. The ink jet recording apparatus according to claim 10, wherein the first nozzle array is formed of a plurality of nozzle chips having a plurality of nozzles, and wherein the second nozzle array is formed of a plurality of nozzle chips having a plurality of nozzles.

16. The ink jet recording apparatus according to claim 15, wherein the plurality of nozzle chips forming the first nozzle array and the plurality of nozzle chips forming the second nozzle array are staggered.

* * * * *